US008755548B2

(12) United States Patent
Zhao et al.

(10) Patent No.: US 8,755,548 B2
(45) Date of Patent: Jun. 17, 2014

(54) EAR MOULD AND HEARING AID WITH OPEN IN-EAR RECEIVING DEVICE

(75) Inventors: David Yong Zhao, Changshu (CN); Jennifer Jinping Zhao, Changshu (CN)

(73) Assignee: Jiangsu Betterlife Medical Co., Ltd, Changshu (CN)

( * ) Notice: Subject to any disclaimer, the term of this patent is extended or adjusted under 35 U.S.C. 154(b) by 0 days.

(21) Appl. No.: 13/497,253

(22) PCT Filed: Jul. 19, 2010

(86) PCT No.: PCT/CN2010/001081

§ 371 (c)(1),
(2), (4) Date: Mar. 21, 2012

(87) PCT Pub. No.: WO2011/088600

PCT Pub. Date: Jul. 28, 2011

(65) Prior Publication Data

US 2013/0004004 A1 Jan. 3, 2013

(30) Foreign Application Priority Data

Jan. 25, 2010 (CN) ..... 2010 1 0112613
Jul. 7, 2010 (CN) ..... 2010 1 0219307

(51) Int. Cl.
*H04R 25/00* (2006.01)

(52) U.S. Cl.
CPC ..... *H04R 25/652* (2013.01); *H04R 25/654* (2013.01); *H04R 2460/11* (2013.01)
USPC ..... 381/328; 381/325; 381/380

(58) Field of Classification Search
CPC .. H04R 25/652; H04R 25/654; H04R 25/656; H04R 2460/11
USPC ..... 381/322, 325, 328, 329, 380; 181/129, 181/130
See application file for complete search history.

(56) References Cited

U.S. PATENT DOCUMENTS

| | | | | |
|---|---|---|---|---|
| 4,987,597 | A * | 1/1991 | Haertl | 381/325 |
| 6,513,621 | B1 * | 2/2003 | Deslauriers et al. | 181/130 |
| 6,795,562 | B1 * | 9/2004 | Gunnersen et al. | 381/325 |
| 7,058,192 | B2 * | 6/2006 | Muller et al. | 381/326 |
| 8,023,675 | B2 * | 9/2011 | Tilson et al. | 381/325 |
| 2004/0240694 | A1 * | 12/2004 | Wolf | 381/322 |
| 2005/0123163 | A1 * | 6/2005 | Oliveira et al. | 381/380 |
| 2005/0249369 | A1 * | 11/2005 | Angst et al. | 381/322 |

(Continued)

FOREIGN PATENT DOCUMENTS

CN 101218851 7/2008

OTHER PUBLICATIONS

International Search Report of PCT/CN2010/001081.

*Primary Examiner* — Curtis Kuntz
*Assistant Examiner* — Joshua A Kaufman

(57) ABSTRACT

An ear mold, in cooperation with a receiving device which is placed in an ear canal. The ear mold includes a head of the ear mold and a sound transmission device which is connected with the head. The sound transmission device is used for connection with the speaker of the hearing aid. The head of the ear mold is integrated with the sound transmission device. An end of sound transmission device which is connected with the hearing aid is elastic. The part of the sound transmission device which is connected with the head of the ear mold is flexible.

8 Claims, 5 Drawing Sheets

(56) References Cited

U.S. PATENT DOCUMENTS

| | | | | |
|---|---|---|---|---|
| 2008/0019549 | A1* | 1/2008 | Ochsenbein | 381/325 |
| 2008/0019554 | A1 | 1/2008 | Krywko | |
| 2008/0187159 | A1 | 8/2008 | Blanchard | |
| 2008/0298618 | A1 | 12/2008 | Baumann et al. | |
| 2009/0101433 | A1* | 4/2009 | Stiehl et al. | 181/129 |
| 2009/0147978 | A1* | 6/2009 | Sauer et al. | 381/324 |
| 2010/0086159 | A1* | 4/2010 | Gabathuler et al. | 381/328 |
| 2011/0092948 | A1* | 4/2011 | Shachar et al. | 604/500 |
| 2012/0219167 | A1* | 8/2012 | Yoong et al. | 381/325 |

* cited by examiner

EAR MOULD AND HEARING AID WITH OPEN IN-EAR RECEIVING DEVICE

TECHNICAL FIELD

The present patent application relates to an ear mould, in particularly relates to an ear mould which is for the open in-ear receiver of a hearing aid. It made the action of the in-ear sound receiver putting in and putting out ear canal and the positioning of it in therein convenient. It improves the delivering gain loss and the comfortable extent of wearing, and reduced the feedback and occlusion; the present patent application also relates to a hearing aid with an open in-ear sound receiver.

BACKGROUND

At present, the companies supplying the hearing aid normally focus their attention on the improvement of the outputting signal of the hearing aid, suppressing the environment noise and eliminating echoing sound signal, etc. The consequence is that: even the quality of the outputting signal is very good, however the gain portion in the user actually received signal is quite less so that the user still cannot obtain a good listening effect. Normally, a customized hearing aid is put on the auricle of the user, a behind-the-ear aid is put behind of the ear of the user, and there is a distance between the amplified sound or gain distance coming from the speaker or receiver and the eardrum of the user. The interaction between the resistance and deflection in sound transmission may make sound loss when the sound is transmitted in the ear canal with complicated physiological structure. In general, there is about 20%.about.30% gain loss so that many severe hearing loose patient complaining the power of the hearing aid being not enough.

In the field of hearing aid, in general, the positioning of the hearing aid is achieved via the normal earplug, in particularly the positioning of the sound receiving device. The earplug of the conventional hearing aid generally has a certain shape and made from rubber. The known European design numbered by 000007893-0001 and published on Apr. 1, 2003 discloses a hearing aid with earpiece with an earplug. During the use, such an earplug often meets the following situations: sound signal leakage caused from the difference of the length of users' ear canal and movement of ear canal's muscle; strong occlusion effect resulted from the non-flowing of the air near central part of ear canal.

To enhance the working effect of the ear hearing aid, someone design the speaker of the hearing aid extending much depth into the inside of ear so that the speaker can more closer to eardrum and reducing the loose of the sound or the gain loss during the transmission.

However, how the hearing aid can be stably positioned in the ear canal, furthermore ensure the portion of in-ear receiving device of the hearing aid which extended into and left out the ear canal freely and no strong uncomfortable feeling caused to human ear. Besides, how to ensure the relative movement will not be caused with the in-ear receiving device of the hearing aid during the user's talking, eating, drinking and physical movement which can cause the movement of ear canal muscle. And cause the positioning of the in-ear receiving device lose its stability, the leaking of the high voice frequency pressure produced in ear, cause gain loss, how to ensure the low frequency voice frequency caused by the occlusion effect can be properly released, for achieve the solutions to these problems, an optimization analysis to each respective problem is needed. Satisfied solution neither disclosed in the state of art nor is available.

SUMMARY

The aim of the present patent application is to supply an ear mould which is able to help the receiving device of hearing aid freely in and out ear and make it can stable position inside of the deep ear canal so that enhance the using comfort ability of hearing aid, reducing gain loss, enlarging the effective using range of hearing aid.

Another aim of the present patent application is to supply an ear mould which is able to prevent the cerumen inside the ear goes into the inside of the ear mould and effect the hearing aid function thereof, furthermore it can ensure the air flowing between the ear mould and the ear of user and convenient for the user to discharge the sweat so that enhanced the anti-occlusion ability of the hearing aid.

The additional aim of the present patent application is to supply a simple structured ear mould which is able to applied to many kinds of receiving device of the hearing aid so that makes the coupling with each kind of in-ear receiving device of the hearing aid more simple, more humanized for using.

The solution of the present patent application be: An ear mould, cooperation with a hearing aid, used for assisting the positioning and sound transmission of the receiver of hearing aid in the ear canal, comprising a head of the ear mould and a sound transmission device which connected therewith, the sound transmission device being for connection with the speaker of the hearing aid, characterized in that, the head of the ear mould being integrated with the sound transmission device, the end of sound transmission device which is connected with the hearing aid being elastic, the part of the sound transmission device which is connected with the head of the ear mould being flexible.

According to one preferred embodiment of the present patent application, in which a protection component disposed therein, the protection component being shape of pole, at least one through-hole formed when the protection component contact with the ear mould.

According to one preferred embodiment of the present patent application, in which the protection component at least partly positioned in the head of the ear mould.

According to one preferred embodiment of the present patent application, in which the head of the ear mould and the sound transmission device being made of single or composite materials, medical or non-medical grade elastic material, non-metallic or metallic elastic material.

According to one preferred embodiment of the present patent application, in which the head of the ear mould including a front portion, a middle portion and a rear portion, the middle portion of the head of the ear mould contacting with the wall of ear canal when the ear mould positioning in the ear canal, the rear portion of the head of the ear mould at least partly contacted with the sound transmission device.

According to one preferred embodiment of the present patent application, in which the sound transmission device being a hearing hose, the rear portion of the head of the ear mould is slidable or non-slidable free contact with the surface of the hearing hose when it pressed by the wall of ear canal and deformed in the radial direction.

According to one preferred embodiment of the present patent application, in which the rear portion of the head of the ear module is not contact with the external surface of the hearing hose when the ear module is in non-use state and the rear portion of the head of the module is in a free state.

According to one preferred embodiment of the present patent application, in which the head of the ear module being in drum shape and its surface being smooth, there is a space between the middle portion of the head of the ear mould and the sound transmission device.

According to one preferred embodiment of the present patent application, in which the thickness of the wall of the middle portion of the head of the ear mould is less than that of the wall of the front portion and the rear portion.

According to one preferred embodiment of the present patent application, in which the front portion of the head of the ear mould or the portion in which the front portion of the head of the ear mould coupled with the hearing hose disposed with at least one air communication hole which communicated with the space.

According to one preferred embodiment of the present patent application, in which the rear portion of the head of the ear mould or the portion in which the rear portion of the head of the ear mould coupled with the hearing hose disposed with at least one air releasing hole which communicated with the space.

Another aim of the present patent application is to disclose hearing aid with open in-ear receiving device which is able to help the receiving device of hearing aid freely in and out ear and make it can stable position inside of the deep ear canal and able to prevent the cerumen inside the ear goes into the inside of the ear mould and effect the hearing aid function thereof, furthermore it can timely releases the low frequency sound pressure in ear and reduce occlusion effect, ensure the air flowing between the ear mould and the ear of user and convenient for the user to discharge the sweat.

An open in-ear sound receiver of hearing aid, comprising an ear mould and a speaker of with the hearing aid which used association with the ear mould, characterized in that, the ear mould including a head of the ear mould and a sound transmission device connected thereto for connection with the speaker of the hearing aid, the head of the ear mould being integrated with the sound transmission device, the end of the sound transmission device which connected to the speaker of the hearing aid being elastic, the portion in which the sound transmission device coupled with the head of the ear mould is flexible.

According to one preferred embodiment of the present patent application of a hearing aid with open in-ear receiving device, in which a protection component disposed therein, the protection component being shape of pole, at least one through-hole formed when the protection component contact with the ear mould.

According to one preferred embodiment of the present patent application of a hearing aid with open in-ear receiving device, in which the head of the ear mould and the sound transmission device being made of single or composite materials, medical or non-medical grade elastic material, non-metallic or metallic elastic material.

According to one preferred embodiment of the present patent application of a hearing aid with open in-ear receiving device, in which the head of the ear mould including a front portion, a middle portion and a rear portion, the middle portion of the head of the ear mould contacting with the wall of ear canal when the ear mould positioning in the ear canal, the rear portion of the head of the ear mould at least partly contacted with the sound transmission device.

According to one preferred embodiment of the present patent application of a hearing aid with open in-ear receiving device, in which the head of the ear module being in drum shape and its surface being smooth, the sound transmission device being a hearing hose, there being a space between the middle portion of the head of the ear mould and the sound transmission device, the rear portion of the ear module being in a non-contact sate or a sliding state with the external surface of the hearing hose when the ear module is in non-use state.

According to one preferred embodiment of the present patent application of a hearing aid with open in-ear receiving device, in which the front portion of the head of the ear mould or the portion in which the front portion of the head of the ear mould coupled with the hearing hose disposed with at least one air communication hole which communicated with the space; the rear portion of the head of the ear mould or the portion in which the rear portion of the head of the ear mould coupled with the hearing hose disposed with at least one air releasing hole which communicated with the space.

The ear mould and the hearing aid with open in-ear receiving device disclosed in the present patent application, made the head of the ear mould in a drum shape so that the front and rear portion of the head of the ear mould do not contact with the wall of ear canal whereas only the middle portion of the head of the ear mould contact with the wall of ear canal, realized linear contact between ear mould and the wall of ear canal, furthermore via the elastic nature of the head of the ear mould make it stable positioning in ear canal.

The ear mould and the hearing aid with open in-ear receiving device disclosed in the present patent application, thanks to the head of the ear mould integrated together so that a stent in the conventional design is abandoned and made the structure of the hearing aid with open in-ear receiving device more simple, reliable and convenient to organization; Made the ear mould to a standard part so that made it can be used in all kinds of in-ear receiving device of hearing aid, effectively reduced the gain loss of the hearing aid so that enlarge the customer group of small power hearing aid to severe hearing-impaired patient so that enlarge the customer covering range in a very large extent, the present patent application also can convenient the user had have hearing aid directly have the effect of a large power hearing aid but there is no necessary to actually change to large power hearing aid.

The ear mould and the hearing aid with open in-ear receiving device disclosed in the present patent application, thanks to the applying of the protection component so that ensure the cerumen inside the ear cannot go into the ear mould, and can ensure there is a space between the ear mould and the ear so that the air flowing being kept and sweating discharging; The ear mould disclosed in the present patent application, can be sold separately as a single part, also can be taken as an accessory for matching the receiving device of the hearing aid to produce sound, directly put into the depth ear canal, reduced the sound loss which is produced during sound transmitted in complicated physiology structure of ear canal.

DETAILED DESCRIPTION

For an easy understanding to the technical personnel to the advantages and features of the present patent application, the following a detailed description made by reference to the drawings of the preferred embodiments so that make a more specified definition to the protection scope of the present patent application.

Figure 1:
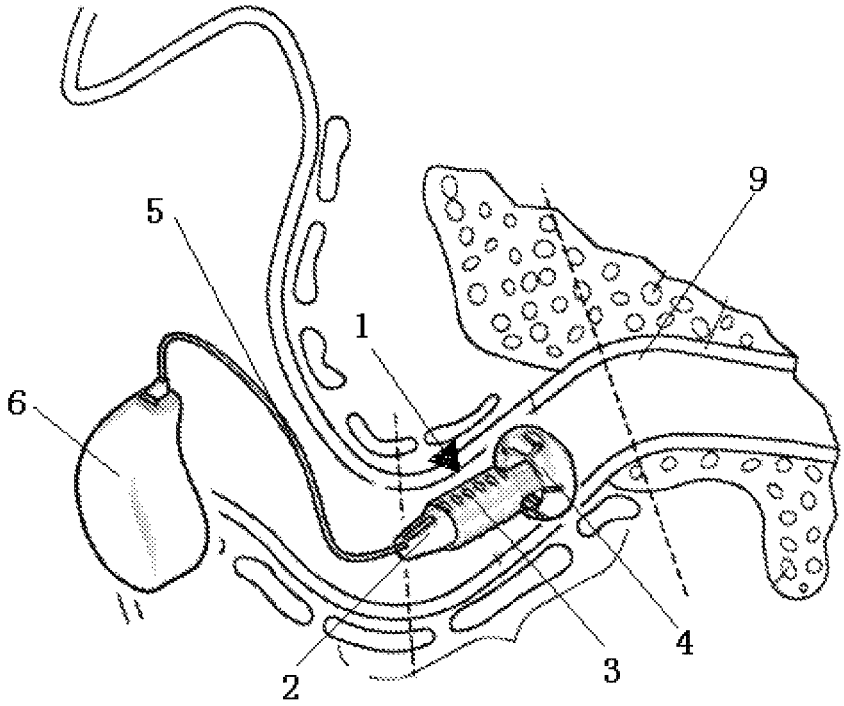
FIG. 1 is an schematic view of one embodiment of the ear mould and the hearing aid with open in-ear receiving device of the present patent application in using state (top view of ear canal)

As FIG. 1 shows, the hearing aid 1 comprising a speaker 2 (also called receiving device), one end of the speaker 2 via interference fit or glue bonded in the sound transmission device 3, the sound transmission device 3 coupled with the head of the ear mould 4, the assembled structure of the sound transmission device 3 and the head of the ear mould 4 hereby called ear mould 20, the speaker cable soft hose 5 disposed on another end of the speaker 2, the speaker cable soft hose 5 connected to the main body 6. In the embodiments of the present patent application, the sound transmission device is the hearing hose.

During working, the head of the ear mould 4 and the sound transmission device 3 are extended into the depth of the ear canal, whereas the speaker 2 connected to the sound transmission device 3. In such way, the receiving device of the hearing aid can more deeply extended into the ear, via the ear mould 20, the sound released by the speaker 2 of the hearing aid 1 can be more effectively sent to the eardrum. Furthermore, the receiving device of the hearing aid is stable positioned in ear canal via the head of the ear mould 4 so that ensure the sound coming from the speaker 2 can be directly sent to human eardrum and reduced the gain loss of the sound which produced by hearing aid 1 made when the sound transmitted in the ear canal, so the working power efficiency of the hearing aid is enhanced.

In the embodiments of the present patent application, the sound transmission device 3 is formed integratedly with the head of the ear mould 4, and made of medical grade elastic material, such as the silicon which hardness less than 60 and having material's biocompartibility so to ensure the elastic deformation and comfort-ability of the portion of the ear mould which contacts to ear canal. The material selection and structural dimension design of the hearing hose and the head of ear mould 41 should be matched, and should sufficiently consideration the avoidance of vibration or co-vibration caused by the sound itself during the sound signal transmitting, (one rule would be that after the hearing hose and the head of the ear mould 4 connected to the receiving device of the hearing aid, the natural power of the hearing system under the environment of ear canal should be above 8000 Hz), Meantime, the head of the ear mould 4 has certain flexibility, easy bending, possible to be pressed in the radial direction and convenient for taking out or putting in from the depth of ear canal, comfortable to be wearing. Here, the design of the ear mould allows it to be deformation in ear canal and be kept contact with the ear canal, and make the in-ear receiving device positioned stablely. Hereby the ear mould 20 includes the head of the ear mould 4 and hearing hose which is an in-ear sound receiving device systematically optimized by consideration audiology, acoustics and ear canal physiology-anatomy, which is able to be stablely positioned in the depth ear canal where nearest the human eardrum.

Figure 2:
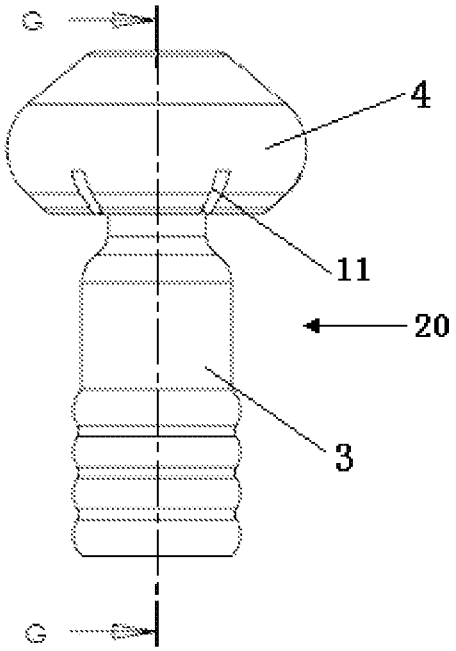
FIG. 2 is an external profile schematic view of one embodiment of the ear mould and the hearing aid with open in-ear receiving device of the present patent application.
Figure 3:
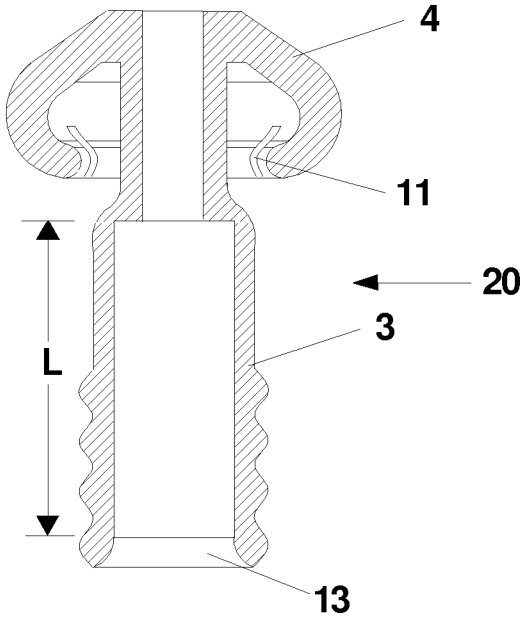
FIG. 3 is a sectional view taken along lines 18-18 of FIG. 2.

As illustrated in FIG. 2 and FIG. 3, in the design of the hearing hose and the head of ear mould 4, the length of which the hearing hose outstanding to the head of ear mould 4 is possible be designed in several levels, the range can be vary from 4 mm~20 mm, so to more adapt to the characters of the ear canal structure of different people group, such as children, the old, the eastern people and the western people. The external diameter of the flexible hearing hose which connected to the speaker 2 of the hearing aid is less than 8 mm, alternatively, any shaped flexible hose of which the length of diagonal line of the cross section is less than 8 mm, including the hoses of which the cross section be a polygon with the number of line segments of 3, 4, 5, 6, 7, 8 etc. The hose can be with one hole or multiple holes; the length of the hearing hose which extended into the speaker 2 could be partly or completely equal to L.

As illustrated in FIG. 2 and FIG. 3, in the cross section view of the head of ear mould 4 and the hearing hose, the ear mould 20 can be divided into head of the ear mould 4, the sound transmission device 3, and they are formed integratedly. one end 13 of the sound transmission device 3, thanks to the nature of medical grade elastic material, made this portion having a certain elastic ability, via the ways including interference fit in the radial direction or gluing, convenient to ring on the speaker, so made the ear mould 20 could be a standard universal component, could match with all kinds of in-ear receiving device of the hearing aid which produced by many companies so that could be applied to all kinds of product which are available now days, consequently the applying scope of the ear mould 20 which disclosed in the present patent application is enlarged, and the using efficiency and using life of all kinds of hearing aids which are available now days.

Figure 8:
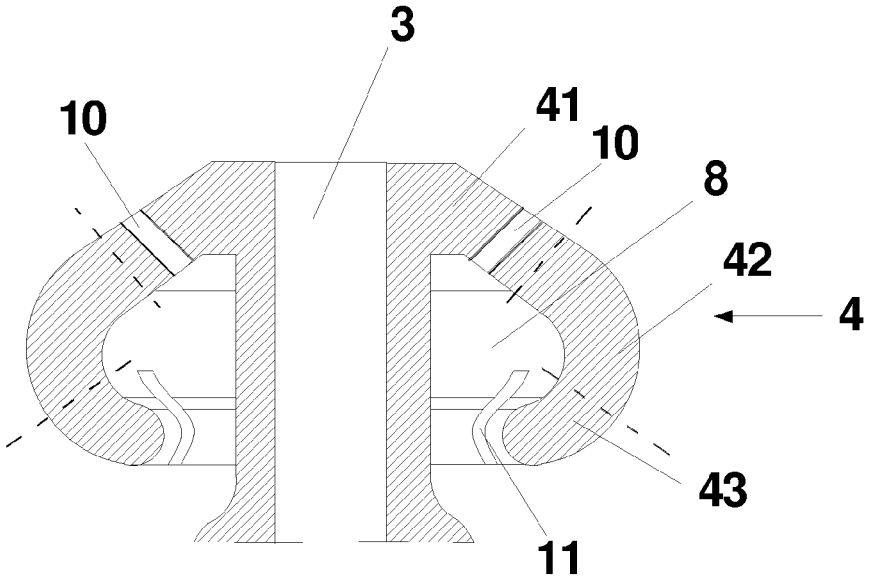
FIG. 8 is a structural schematic view of one embodiment of the head of the ear mould in the present patent application.

As shown in FIG. 8, in the partly cross section view of the ear mould 20 and the hearing hose, the head of the ear mould could be divided into the front portion of the head of the ear mould 41, the middle portion of the head of the ear mould 42 and the rear portion of the head of the ear mould 43, wherein the front portion of the head of the ear mould 41 is integrated with the hearing hose. In non-using state, the rear portion of the head of the ear mould 43 could be surface sliding contact in the axial with the hearing hose, the rear portion of the head of the ear mould 43 can be a contacting, non-contacting original state relative to the hearing hose. During the using of the ear mould 20, thanks to the movement of ear mould 20 in the axial direction, the head of the ear mould 4 and the wall of the ear canal 9 pressed in radial direction, so made the rear portion of the head of the ear mould 43 produced slip erring friction movement in the axial direction relative to the hearing hose.

Besides, an air-filled sac can be disposed inside of the head of the ear mould 4 so that realizing the later can free deform when it is exert pressure, this made that could be possible of no space between the middle portion of the head of the ear mould 42 and the hearing hose, both of them contact directly.

In the embodiments of the present patent application, the head of the ear mould 4 is design in a drum shape, the surface of it be smooth, so the discomfort feeling during it contact with the ear canal is reduced. In general, the head of the ear mould 4 is a part with flexibility, when meet pressure in its radial direction, a certain extent deformation in radial direction and extension in axial direction can free happened, so that made the head of the ear mould 4 is possible deformation in its radial direction and reduce its diameter and convenient it is put into ear canal and positioned therein. The head of the ear mould 4 can carry out a superficial processing, such as coating ETFE, PTFE, Parylene, Parylin, Parylast, Polyurethane, Polyethylenimin, Polyimide layer, or plating foil, etc.

In the using state, the greater diameter of the middle portion of the head of the ear mould 42 takes the pressure coming from the wall of the ear canal 9, so made the part of the greater diameter of the middle portion of the head of the ear mould 42 deformed and then made the rear portion of the head of the ear mould 43 at least partly contact with the surface of the hearing hose, by the contact between the greater diameter portion of the middle portion of the head of the ear mould 42 to the wall of the ear canal 9, the contact between the front portion of the head of the ear mould 41 and the hearing hose, the contact between the rear portion of the head of the ear mould 43 and the hearing hose, made the head of the ear mould 4 and the hearing hose support each other in the ear canal, so that made the head of the ear mould 4 and the hearing hose are stablely kept in the ear canal, rather easily sliding inside or coming out from the ear canal by the interference from sound wave. The contact between the front portion of the head of the ear mould 41 and the hearing hose, The contact between the rear portion of the head of the ear mould 43 and the hearing hose made the deformation which happened to the greater diameter portion of the middle portion of the head of the ear mould 42 more stablely. Thanks to the head of the ear mould is closer to the human eardrum, at the same time of avoidance or reducing the power loss of the hearing aid; also reduced the occlusion effect which the ear mould produced to the ear canal in a large extent, consequently, the comfort-ability of wearing is enhanced.

In the embodiments of the present patent application, the facial contact or linear contact formed between the greater diameter portion of the middle portion of the head of the ear mould 42 and the wall of the ear canal 9, the rear portion of the head of the ear mould 43 and the hearing hose, so that the stable positioning obtained thereof. Concretely, could make the curve of the contacting portion between the greater diameter portion of the middle portion of the head of the ear mould 42 and the rear portion of the head of the ear mould 43 and the hearing hose smaller. Ensure there is a certain contacting surface between the middle portion of the head of the ear mould 42 and the wall of the ear canal, the contacting length in axial direction lies in the range of 0.1 mm~5 mm, maintain the middle portion of the head of the ear mould 42 from the wall of the ear canal 9 a certain contacting pressure not only can strength the mounting between the head of the ear mould and the wall of ear canal but also can maintain the pressure of sound wave and preventing the leakage of sound intensity. Along the axial direction of ear canal, the hearing hose could be in straight shape or be in a curved shape which pre-determined according to the curved shape of ear canal.

Figure 5:
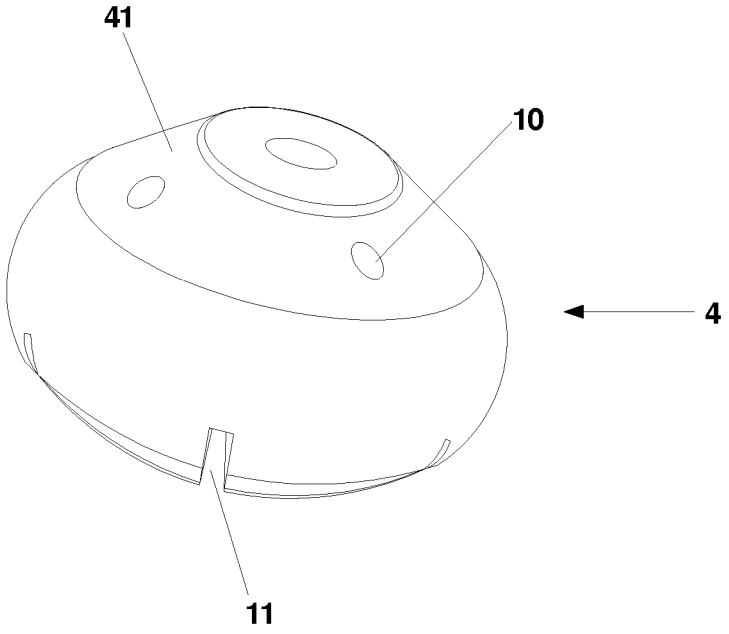
FIG. 5 is a structural schematic view of the air communication hole in one embodiment of the ear mould in the present patent application.
Figure 9:
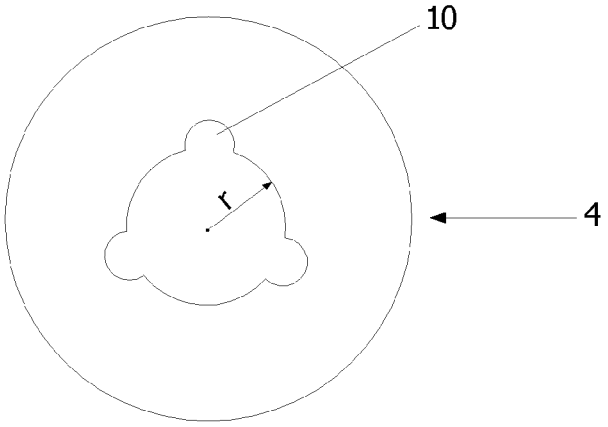
FIG. 9 is a structural schematic view of one more embodiment of the head of the ear mould in the present patent application.

As illustrated in FIG. 5, FIG. 8 and FIG. 9, for effectively release the low frequency sound pressure between the ear mould 20 of the hearing aid 1 and the inside of ear canal, at least air communication hole 10 disposed between the head of the ear mould 4 and the sound transmission device 3, the air communication hole 10 is communicated with the space 8, so the low frequency sound pressure effectively is released. As the low frequency sound pressure more concentrate on the external surface of the hearing hose, whereas on the surround of the greater diameter portion of the middle portion of the head of the ear mould 42 where contacting the wall of the ear canal 9, what concentrated there is the high frequency sound intensity, thus disposed the air communication hole 10 at the position where is closer the surrounding of external wall of the hearing hose, so that the low frequency sound intensity release very soon. In the embodiments of the present patent application, 4 air communication holes symmetry disposed, however, the amount of the air communication hole 10 may changed according to the actual requirement. The air communication hole 10 may be directly pre-disposed at the front portion of the head of the ear mould 41, also may pre-set some space at the front portion of the head of the ear mould 41, after a deformation result from the radial pressure of ear canal, via a compound forming together with the hearing hose to gain the air communication holes 10 (as what shown in FIG. 9). For effectively preventing the occlusion effect, the diameter of the air communication holes 10 is greater than 0.5 mm after deformation, for air flowing and preventing the occlusion effect, the disposing of the air communication holes 10 along the length direction of ear canal may be a detour line, so that reducing the sound wave of the speaker or sound intensity leakage, reducing the sound wave outside the ear canal comes into the ear canal. During the deformation of the head of the ear mould 4, the air communication holes 10 is disposed not deformed or nearly not deformed, so to ensure the air flows smoothly. The shape of the air communication holes 10 may be circle shape or square shape.

As illustrated in FIG. 5 and FIG. 8, during the assembling of the rear portion of the head of the ear mould 43, at least one air releasing hole 11 disposed as well, the air releasing hole 11 is communicated with the space 8, so to ensure the air communication hole 10, the space 8 and the air releasing hole 11 are communicated each other, so that the low frequency sound intensity can be smoothly released. In the same principle, the disposing of the air releasing hole 11 may take a reference to that of the air communication hole 10, disposing plurality and the location closer to the external wall of the hearing hose. The air releasing hole 11 may directly is the through-hole which disposed at the rear portion of the head of the ear mould 43, alternatively, may pre-set space thereon, after a deformation caused by the radial pressing from the wall of the ear canal, via the assembly with the hearing hose to gain the air releasing holes 11. Also may via the rear portion of the head of the ear mould 43 be radial pressing and deformed so that formed non-linear contacting to the hearing hose surrounding and gained at least air releasing hole 11 along the external surface of the wall of the hearing hose, in the embodiment of the present patent application, 4 air releasing holes 11 symmetry formed.

The thickness of the wall of the front portion of the head of the ear mould 41, the middle portion of the head of the ear mould 42 and the rear portion of the head of the ear mould 43 is designed with unconformity. whereof the thickness of the wall of the middle portion of the head of the ear mould 42 is less than that of the front portion of the head of the ear mould 41 and that of the rear portion of the head of the ear mould 43, made the middle portion of the head of the ear mould 42 can take more strong radial pressure during it contacting with the wall of the ear canal and be pressed in radial direction, Supply enough stable supporting power for the front portion of the head of the ear mould 41 and the rear portion of the head of the ear mould 43, and prevent the middle portion of the head of the ear mould 42 from depression towards the central direction or structure loose stability.

What can be concluded from the foregoing description is that the main function of the head of the ear mould 4 in the hearing aid 1 including: preventing leakage of the sound intensity (in particularly the leakage of the high frequency sound intensity) which may happened on the surrounding of the middle portion of the head of the ear mould; supplying the air flowing passage in the area where closer to the central position, so to prevent the occlusion effect; supporting and fixing the speaker 2 and the hearing hose, preventing the sliding or dislocation, preventing vibration or resonance; wearing softly and considered the comfort-ability of human, easy to put into and take out from ear canal.

Figure 4:
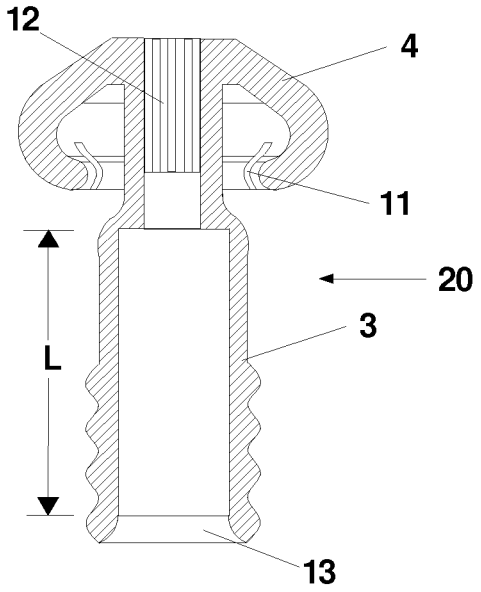
FIG. 4 is a sectional view of one embodiment of the ear mould and the hearing aid with open in-ear receiving device of the present patent application.
Figure 6:
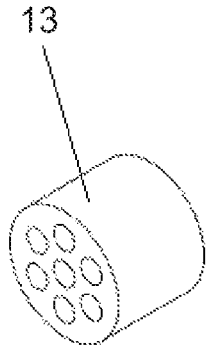
FIG. 6 is a schematic view of one embodiment of the protection component of the ear mould in the present patent application.
Figure 7:
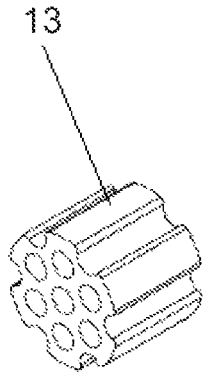
FIG. 7 is a schematic view of one more embodiment of the protection component of the ear mould in the present patent application.

As shown in FIG. 4, in the embodiments of the present patent application, a protection component 13 disposed in the head of the ear mould 4. the aim to dispose the protection component is that to prevent the dirty things or cerumen goes into the hearing hose of the ear mould 20 so as to effect the sound transmission efficiency of the ear mould 20. The shape of the protection component 13 may design in the column shape shown in FIG. 6 and FIG. 7, surely, it also may be designed in other shapes such as rectangle shape, after the assembly of the protection component 13 to the head of the ear mould 4, ensure leave smoothly communicated through-holes between the head of the ear mould 4 and the protection component 13, so as to ensure the smooth transmission of the sound, because the through-holes are very small, so that the dirty things in the ear cannot come into the head of the ear mould 4.

In the embodiments of the present patent application, the protection component 13 may be made of ABS plastic etc. The hardness is a little bit hard, additionally it can have the function on radial supporting inside of the head of the ear mould 4. Furthermore, the head of the ear mould 4 may be separated from the protection component 13, so that convenient to the exchange or cleaning of the protection component 13.

The length of the protection component 13 can be free set, in the embodiments of the present patent application, take the protection component 13 lies in the head of the ear mould as example, however, the protection component 13 may disposed into the hearing hose as well, here set no limitation.

The ear mould disclosed in the present patent application, can be standardized design and manufacture, so as to be sold as a sole product, incorporately use together with exist all kinds of hearing aid with in-ear receiving device and enhancing the using efficiency and life of all kinds of hearing aids. as the accessory the ear mould also can be sold together with the hearing aid, so as to make the outputting sound of exist hearing aids can be more efficiently directly transmitted to human eardrum. And, the ear mould disclosed in the present patent application with simple structure, reliable, easy assembling, having no need the extra supporting from a stent. Moreover, the applying of the protection component, making the possibility of the inside of the ear mould blocked by cerumen in ear canal is reduced in a very large extent, also convenient to the cleaning and exchanging of the protection component.

The ear mould disclosed in the present patent application includes the head of the ear mould and the hearing hose, the systematical structure is more simple, reliable, convenient to assembly, could according to the complicated physiology structure of the ear canal deform in the ear canal and keeping elastic contact therewith and stabilize the in-ear receiving device, long time wearing still fell comfort; could be standardized, and convenient to match with all kinds of in-ear receiving device, could prevent cerume goes into the ear mould, and could ensure a certain space 8 between the ear mould and the ear canal, keeping air smoothly flow in the ear canal and sweat discharging, more important is that it systematically optimized by consideration audiology, acoustics and ear canal physiology-anatomy, which is able to be stable positioned in the depth ear canal where nearest the human eardrum, effectively reduce the gain loss of the audio signal in hearing aid, so as to let the hearing-impaired patient can effectively receiving the signal outputted by hearing aid, that is to say, factually make the applying scope of the hearing aids with the small or middle power be enlarged to the severe patient.

The foregoing description, only is the embodiments of the present patent application, however the protection scope of the present patent application is not limited to there. Any alternative solution or replacing solution within the disclosure of the present patent application and made by the person skilled in the art without creative labor covered in the protection scope of the present patent application. Thus, the protection scope of the present patent application should bear the protection scope which limited by the claims.

What is claimed is:

1. An ear mould, in cooperation with a hearing aid, used for assisting positioning and sound transmission of a receiver of the hearing aid in an ear canal, comprising a head of the ear mould and a sound transmission device connected with the head of the ear mould, the sound transmission device being for connection with a speaker of the hearing aid, wherein the head of the ear mould is integrated with the sound transmission device, the end of sound transmission device which is connected with the hearing aid is elastic, the part of the sound transmission device which is connected with the head of the ear mould is flexible; and a protection component is disposed in the ear mould, the protection component is pole-shaped, a plurality of air communication holes are formed when the protection component contacts with the ear mould;

wherein the head of the ear mould comprises a front portion, a middle portion and a rear portion, the middle portion of the head of the ear mould contacts with a wall of the ear canal when the ear mould is positioned in the ear canal, the rear portion of the head of the ear mould at least partly contacts with the sound transmission device;

wherein the sound transmission device is a hearing hose, the rear portion of the head of the ear mould slidably or non-slidably contacts with a surface of the hearing hose when it is pressed by the wall of ear canal and deformed in a radial direction;

wherein the rear portion of the head of the ear module does not contact with an external surface of the hearing hose when the ear module is in non-use state and the rear portion of the head of the module is in a free state;

wherein the head of the ear module is drum-shaped and its surface is smooth, there is a space between the middle portion of the head of the ear mould and the sound transmission device;

wherein the front portion of the head of the ear mould or a portion in which the front portion of the head of the ear mould coupled with the hearing hose comprises at least one air communication hole communicated with the space;

wherein the rear portion of the head of the ear mold has a plurality of slots arranged along an outer peripheral edge that form air outlet through holes when they are deformed in the radial direction and pressed against the hearing hose.

2. An ear mould as claimed in claim 1, wherein the protection component is at least partly positioned in the head of the ear mould.

3. An ear mould as claimed in claim 2, wherein the head of the ear mould and the sound transmission device are made of single or composite materials, medical or non-medical grade elastic material, non-metallic or metallic elastic material.

4. An ear mould as claimed in claim 1, wherein a thickness of the wall of the middle portion of the head of the ear mould is less than that of the wall of the front portion and the rear portion.

5. An ear mould as claimed in claim 1, wherein a plurality of grooves is defined on the periphery the protection component, so that a plurality of air communication holes are formed when the protection component contacts with the ear mould.

6. An open in-ear sound receiver of a hearing aid, comprising an ear mould and a speaker of the hearing aid which is used in association with the ear mould, wherein the ear mould comprises a head of the ear mould and a sound transmission device connected thereto for connection with the speaker of the hearing aid, the head of the ear mould is integrated with the sound transmission device, an end of the sound transmission device which is connected to the speaker of the hearing aid is elastic, a portion in which the sound transmission device is coupled with the head of the ear mould is flexible; and a protection component is disposed in the ear mould, the protection component is pole-shaped, a plurality of air communication holes are formed when the protection component contacts with the ear mould;

wherein the head of the ear mould comprises a front portion, a middle portion and a rear portion, the middle portion of the head of the ear mould contacts with a wall of an ear canal when the ear mould is positioned in the ear canal, the rear portion of the head of the ear mould at least partly contacts with the sound transmission device;

wherein the head of the ear module is in a drum shape and its surface is smooth, the sound transmission device is a hearing hose, there is a space between the middle portion of the head of the ear mould and the sound transmission device, the rear portion of the ear module is in a non-contact state or a sliding state with an external surface of the hearing hose when the ear module is in a non-use state;

wherein the front portion of the head of the ear mould or the portion in which the front portion of the head of the ear mould is coupled with the hearing hose comprises at least one air communication hole communicated with the space; the rear portion of the head of the ear mold has a plurality of slots arranged along an outer peripheral edge that form air outlet through holes when they are deformed in a radial direction and pressed against the hearing hose.

7. An open in-ear sound receiver of hearing aid as claimed in claim 6, wherein the head of the ear mould and the sound transmission device are made of single or composite materials, medical or non-medical grade elastic material, non-metallic or metallic elastic material.

8. An open in-ear sound receiver of hearing aid as claimed in claim 6, wherein a plurality of grooves are defined on the periphery of the protection component, so that a plurality of air communication holes are formed when the protection component contacts with the ear mould.

* * * * *